US006838147B2

(12) United States Patent
Burns, Jr. et al.

(10) Patent No.: US 6,838,147 B2
(45) Date of Patent: Jan. 4, 2005

(54) SURFACE COVERING BACKING CONTAINING POLYMERIC MICROSPHERES AND PROCESSES OF MAKING THE SAME

(75) Inventors: Alonzo M. Burns, Jr., Mauricetown, NJ (US); Hao A. Chen, Chadds Ford, PA (US); Nicholas Zerebecki, Mullica Hill, NJ (US); Charles Patterson, Adaivsville, GA (US)

(73) Assignee: Mannington Mills, Inc., Salem, NJ (US)

( * ) Notice: Subject to any disclaimer, the term of this patent is extended or adjusted under 35 U.S.C. 154(b) by 0 days.

(21) Appl. No.: 09/228,954

(22) Filed: Jan. 12, 1999

(65) Prior Publication Data

US 2003/0157295 A1 Aug. 21, 2003

Related U.S. Application Data

(60) Provisional application No. 60/071,110, filed on Jan. 12, 1998.

(51) Int. Cl.[7] ..... B32B 3/26; B32B 5/18; B32B 5/30; B32B 27/22

(52) U.S. Cl. ..... 428/95; 428/323; 428/327; 428/313.3; 428/313.5; 428/314.4

(58) Field of Search ..... 428/95, 323, 327, 428/313.3, 313.5, 314.4, 326, 314.2

(56) References Cited

U.S. PATENT DOCUMENTS

| | | | | |
|---|---|---|---|---|
| 3,616,138 A | | 10/1971 | Wentworth et al. | 161/67 |
| 3,661,691 A | | 5/1972 | Solsberg | 161/67 |
| 3,708,441 A | * | 1/1973 | Joslyn et al. | 260/2.5 P |
| 3,819,463 A | | 6/1974 | Ervin et al. | 161/64 |
| 3,940,525 A | | 2/1976 | Ballard | 428/96 |
| 3,982,051 A | | 9/1976 | Taft | 427/208 |
| 4,252,910 A | * | 2/1981 | Schaefer | 36/117.1 |

FOREIGN PATENT DOCUMENTS

| | | | |
|---|---|---|---|
| EP | 0 270 330 | | 11/1987 |
| EP | 0 560 325 | A1 | 10/1993 |
| FR | 2160422 | * | 6/1973 |
| FR | 2496739 | * | 12/1980 |
| FR | 2 496 739 | | 12/1980 |
| GB | 1 515 521 | * | 6/1978 |
| JP | 354155837 | A | 12/1979 |
| JP | 356030473 | A | 3/1981 |
| JP | 359173132 | A | 10/1984 |
| JP | 85 119240 | | 4/1985 |

OTHER PUBLICATIONS

US 3,684,181, 8/1972, Wolinski et al. (withdrawn)*

P. Ellis, Carpet Substrates, 1973, The Textile Trade Press, Chapters 7 and 8, pp. 71–98.*

"Material for Carpet Tile Backing," by J.E. Cheetham, Carpet Substrates, P. Ellis, ed., pp. 81–98, 1973.*

Principles of Polymer Systems, 2nd ed., F. Rodriguez, p. 362, 1982.*

L. Shoshkes, Contract Carpeting, Chapter 4, pp. 60–67, 1974.*

J. Levinstein, The Complete Carpet Manual, page p. 27, 1992.*

(List continued on next page.)

*Primary Examiner*—Cheryl A Juska
(74) *Attorney, Agent, or Firm*—Kilyk & Bowersox, P.L.L.C.

(57) ABSTRACT

A secondary backing for surface coverings is disclosed which comprises at least one thermoplastic material optionally having polymeric microspheres dispersed therein. A textile substrate comprising a primary backing with textile fibers extending upwardly from the backing and forming a surface and the above-described secondary backing attached thereto is also described. Methods of making the textile substrate and the secondary backing which can be foam or hardback are also described. Also described is a resilient surface covering, such as vinyl flooring, using the secondary backing of the present invention in one or more layers.

22 Claims, 2 Drawing Sheets

Tufted Tile - Cushion-Backed

Y 1. Yarn - (Nylon, polypropylene, etc.)
S 2. Tufting substrate - (non-woven polyester) (Primary Backing)
P 3. Adhesive precoat - (PVC) (e.g., Vinyl Pre Coat)
B 4. Intermediate coat - (PVC) Hardback (Secondary Backing hardback)
F 5. Stabilizer - (non-woven fiberglass) cloth
C 6. Secondary coat - (PVC foamed) Cushion Back

U.S. PATENT DOCUMENTS 4,269,881 A * 5/1981 Johnson et al. ..... 156/72
4,416,926 A 11/1983 Maglio ..... 428/31
4,500,591 A 2/1985 Peltier et al. ..... 428/251
4,689,256 A 8/1987 Slosberg et al. ..... 428/95
4,726,986 A 2/1988 Cannady et al. ..... 428/278
4,740,407 A 4/1988 Schaefer et al. ..... 428/87
4,840,672 A 6/1989 Baes ..... 106/86
4,879,163 A 11/1989 Woiceshyn ..... 428/198
4,950,525 A 8/1990 Bailey ..... 428/164
5,112,657 A 5/1992 Melber ..... 428/15
5,196,246 A 3/1993 Kauss ..... 428/39
5,212,215 A 5/1993 Nanri et al. ..... 523/218
5,217,552 A 6/1993 Miyajima ..... 156/71
5,229,437 A 7/1993 Knight ..... 523/219
5,264,467 A * 11/1993 DiStefano ..... 523/218
5,332,760 A * 7/1994 Weisman ..... 521/137
5,384,345 A 1/1995 Naton ..... 523/218
5,407,617 A * 4/1995 Oppermann et al. ..... 264/46.4
5,545,276 A * 8/1996 Higgins ..... 156/79
5,607,993 A * 3/1997 Christy ..... 524/237
5,639,539 A 6/1997 DeProspero et al. ..... 428/195
5,656,109 A * 8/1997 Schilling et al. ..... 156/63
5,658,969 A * 8/1997 Gerace ..... 523/218
5,665,461 A * 9/1997 Wong et al. ..... 523/218
6,103,152 A * 8/2000 Gehlsen et al. ..... 264/45.4
6,162,748 A * 12/2000 Schilling et al. ..... 156/72
6,316,075 B1 * 11/2001 Desai et al. ..... 428/297.4

* cited by examiner

Tufted Tile - Cushion-Backed

| | | |
|---|---|---|
| Y | 1. | Yarn - (Nylon, polypropylene, etc.) |
| S | 2. | Tufting substrate - (non-woven polyester) (Primary Backing) |
| P | 3. | Adhesive precoat - (PVC) (e.g., Vinyl Pre Coat) |
| B | 4. | Intermediate coat - (PVC) Hardback (Secondary Backing hardback) |
| F | 5. | Stabilizer - (non-woven fiberglass) cloth |
| C | 6. | Secondary coat - (PVC foamed) Cushion Back |

Tufted Tile - Hardback

1. Yarn - (Nylon, polypropylene, etc.)
2. Tufting substrate - (non-woven polyester)
3. Adhesive precoat - (PVC)
4. Intermediate coat - (PVC) - Hardback
5. Stabilizer - (non-woven fiberglass)
6. Secondary coat - (PVC) - Hardback

SURFACE COVERING BACKING CONTAINING POLYMERIC MICROSPHERES AND PROCESSES OF MAKING THE SAME

This application claims the benefit of provisional application 60/071,110 filed on Jan. 12, 1998.

BACKGROUND OF THE INVENTION

The present invention relates to the backing on surface coverings, preferably carpet backings, and more particularly relates to the use of polymeric microspheres in the backings of surface coverings, such as carpets and resilient floor coverings.

Generally, surface coverings have a backing layer wherein a surface of the backing layer rests against the sub-surface or sub-floor on which it is applied, such as a concrete or wood floor.

The commercial carpet market in United States is approximately 80% 12 ft. wide broadloom carpets and 20% modular tiles and 6 ft. wide roll goods. The most popular modular size in U.S. is 18"×18" and to a much lesser extent 24"×24" and 36"×36" modular sizes are also used. Modular tiles are predominantly vinyl backed.

The modular tiles are gaining more and more of market share in the office environment because: (1) Modular tiles allow easy access to subfloor for utilities; (2) Less disruption in office work during installation or replacement; (3) Easy to reconfigure modular furniture in open office planning situations with carpet modules; (4) Ease of transport in multi-story buildings; (5) Unlimited design flexibility; (6) Easy to install and remove; (7) Durable and cost effective; (8) Ability to replace damaged tile selectively; and (9) High performance.

The most predominantly used material for 6 ft. wide roll goods in U.S. is based on polyvinyl chloride, often referred to as "vinyl".

The 6 ft. vinyl backed roll goods are also increasing their market share in healthcare, institutional and other markets due to their higher performance over broadloom carpet, ability to provide wall to wall moisture barrier due to chemically weldable properties of vinyl at carpet seams, superior dimensional stability, easy to transport, install and remove carpet, as well as it's lower cost based on life cycle.

The carpet tiles and 6 ft. wide roll goods have been growing rapidly in the last 25 years. They are different in properties and end use applications compared to traditional 12 ft. wide SBR latex backed carpets. The SBR latex chemistry is aqueous system (water based) where as the vinyl chemistry is non-aqueous. SBR latex backed carpets are hard backed and as such, they are glued to the floor or installed over a cushioned padding. SBR latex backed carpet as compared to vinyl backed modular tiles or 6 ft. roll goods are in a totally different category. This is due to the fact that one can not take SBR latex backed 12 ft. wide carpet and cut it into 18"×18" carpet tiles or 6 ft. wide roll goods and expect the same functionality.

The construction and components of carpet tiles and 6 ft. vinyl backed roll goods are completely different. The vinyl backed products are engineered products with a different cross section and use a non-woven fiberglass fleece or scrim.

The unique properties of vinyl backed products such as superior dimensional stability, double moisture barrier, high wet tuft bind, chemically weldable carpet seams, ability to withstand repeated wet cleanings are not exhibited by 12 ft. wide SBR backed carpet and hence it is clear that SBR backed 12 ft. wide broadloom carpet and 18"×18" vinyl backed carpet tiles or 6 ft. wide vinyl backed roll goods are different products. The modular tiles and 6 ft. roll goods are offered with hardback backings as well as cushioned backings.

Recently, cushion backed products are increasing in demand because they offer better under foot comfort and hence better ergonomics as well as better appearance retention of the face of the carpet.

The 6 ft. wide, vinyl cushion backed roll goods and 18"×18" vinyl cushion backed modular products are available in the market place today. These vinyl foam backed products predominantly use closed-cell chemical foam. The closed-cell foams are achieved by the use of a blowing agent which blows the original thickness by 3 to 4 times when subjected to relatively high temperatures generally between 380° F.–400° F. Since the production of closed-cell chemical foam generally requires relatively high blow ratios (3–4) and high temperatures it can not be applied and be blown directly on the back of the carpet. Hence, production on vinyl foam backed modules and 6 ft. roll goods is currently achieved in the following three steps.

Step-1 Apply pre-coat to the tufted carpet.

Step-2 Produce closed-cell PVC foam as a separate process.

Step-3 Laminate previously pre-coated carpet with pre-manufactured PVC foam closed-cell PVC foam sheet.

Further, there are some disadvantages of this three step process. They are as follows:

(1) Poor dimensional stability because process requires hot lamination at elevated temperatures (approx. 350° F.–360° F.) of vinyl foam to the pre-coated carpet under extremely well controlled tension conditions. In actual manufacturing it is very difficult to control precise temperatures, tensions, and orientation of the textile product, such as tufted carpet without distortion.

Further, this process is not capable of incorporating non-woven fiberglass fleece or scrim in the secondary backing composite. The net result is this process produces a dimensionally unstable product. In order to overcome this difficulty, the carpet is sold with very aggressive, factory applied adhesive. This adhesive is so aggressive that removal of the carpet is time consuming and very expensive. Many times, the primary backing is removed but the secondary backing still adheres to the sub-floor, due to the poor delamination strength and/or dimensional stability.

(2) The delamination strength of secondary foam backing is often low and uneven due to difficulty in precise process control.

(3) The chemically blown foam still has some open cells which is confirmed by moisture absorption tests (usually 6–10%).

The present invention removes many, if not all of the disadvantages of currently used methods of manufacturing particularly vinyl foam backed carpet tiles and 6 ft. vinyl foam backed roll goods. Further, the present invention preferably uses a one step process that is easy to control, and where elevated temperatures are not required. Further, fiberglass stabilizers are in use in the backing structure and thus imparts superior dimensional stability. The PVC pre-coat layer provides a moisture barrier at the base of the tufts and wet-on-wet lamination of the adhesive coat and the foam coat imparts superior delamination strength.

SUMMARY OF THE INVENTION

In accordance with the purposes of the present invention, as embodied and broadly described herein, the present invention relates to a secondary backing comprising a thermoplastic material and polymeric microspheres dispersed in the thermoplastic material.

The present invention further relates to a textile substrate comprising a primary backing with textile fibers extending upwardly from the backing and forming a surface and a secondary backing fastened to the opposite of the primary backing.

The present invention further relates to a secondary backing comprising a foamed thermoplastic material having polymeric microspheres dispersed therein. For purposes of the present invention, pre-expanded polymeric microspheres means that the polymeric microspheres are expanded beforehand (e.g., expanded before being dispersed in the secondary backing and substantially no-expansion or no expansion at all of the microspheres occurs during formation of the secondary backing).

The present invention also relates to a textile substrate comprising a primary backing with textile fibers extending upwardly from the backing and forming a surface, and a secondary backing fastened to the opposite side of the primary backing, wherein the secondary backing comprises a foamed thermoplastic material having polymeric microspheres dispersed therein.

The present invention also relates to a method of making a textile substrate comprising forming a primary carpet fabric and affixing a secondary backing to the side of the primary carpet fabric, wherein the secondary backing comprises a thermoplastic material having polymeric microspheres dispersed therein.

An additional embodiment of the present invention is surface coverings which contain a secondary backing wherein the secondary backing contains at least one thermoplastic material and at least one activated blowing agent, wherein the secondary backing is affixed to a primary backing such that there is no delamination under ASTM-D-3936, and wherein the secondary backing is preferably expanded by about 1 to about 2.5 times. Methods of making this secondary backing and incorporating it into the surface covering are also part of the invention.

It is to be understood that both the foregoing general description and the following detailed description are exemplary and explanatory only and are intended to provide further explanation of the present invention, as claimed.

The accompanying drawings, which are incorporated in and constitute a part of the present application, illustrate several embodiments of the present invention and together with the description serve to explain the present invention.

DETAILED DESCRIPTION OF THE PRESENT INVENTION

Figure 1:
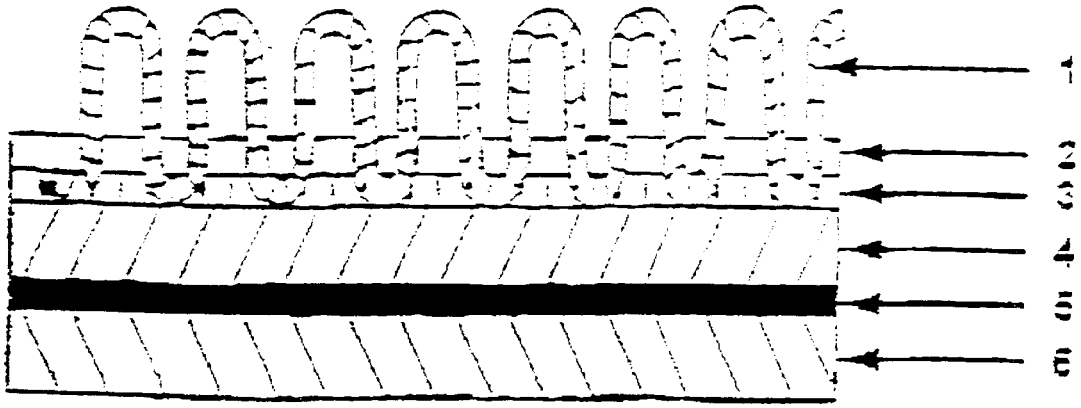
FIGS. 1 and 2 are expanded side views of a carpet product showing the various layers of preferred embodiments of the present invention.

In one aspect of the present invention, the present invention relates to a surface covering having a backing layer, wherein the backing layer is a thermoplastic material having polymeric microspheres dispersed therein. For purposes of the present invention, the surface covering can be any type of surface covering which uses a backing layer. The polymeric microspheres can be pre-expanded (i.e., non-expandable type), and/or expandable polymeric microspheres. For purposes of the present invention, pre-expanded polymeric microspheres means the microspheres are expanded beforehand and not during the formation of the secondary backing, and substantially no expansion or no expansion at all occurs during formation of the secondary backing. Expandable polymeric microspheres means the microspheres expand during formation of the secondary backing. Preferably, the surface covering is a floor covering, and more preferably, the surface covering is a textile substrate, for instance, a carpet. Preferably, the textile substrate is a broadloom carpet, modular tile, or a wide roll carpet (e.g. 6 ft.). Most preferably, the textile substrate is tile or 6 ft. roll goods. Also, the floor covering can be resilient floor covering, such as vinyl flooring and the like.

The textile substrate comprises textile fibers defining a fibrous face, a primary backing to which the textile fibers are secured, and a secondary backing secured to the primary backing. For purposes of the present invention, the term "textile substrate" relates to, but is not limited to, a fiber, web, yarn, thread, sliver, woven fabric, knitted fabric, non-woven fabric, upholstery fabric, tufted carpet, and piled carpet formed, from natural and synthetic fibers.

Since the preferred embodiment is a floor covering and more particularly a textile substrate, the details of the present invention will be directed to such a flooring material with the realization that the present invention can be applied to other types of surface coverings by modifications which would be known to those skilled in the art in view of the disclosure set forth in the present application.

A textile substrate contains a primary backing with textile fibers extending upwardly from the backing and forming a surface. A secondary backing is fastened or affixed to the side of the primary backing which is opposite the wearing surface of the textile substrate. Preferably, the secondary backing is formed directly on the primary backing by a wet-on-wet lamination which leads to a product with no delamination, for instance as determined by ASTM-D-3936.

With regards to the secondary backing material, for purposes of the present invention, the secondary backing is preferably a thermoplastic material. The thermoplastic material can be an aliphatic thermoplastic resin such as one derived by polymerization or copolymerization of an ethylenically unsaturated monomer. The monomer can be a ethylenically unsaturated hydrocarbon such as an olefin or a nitrile (such as an acrylonitrile), vinyl or vinylidene chloride, vinyl acetate, or an acrylate, such as ethylacrylate or methylmethacrylate. More particularly, the thermoplastic material can be a polyethylene, ethylene/vinyl acetate, polyvinyl chloride, polyisobutylene, and the like. Preferably, the thermoplastic material is a vinyl-type material such as a vinyl resin and more particularly a polyvinyl chloride-type material. Also, at least one plasticizer is also present.

Suitable polymers for the backing layers of the present invention can be derived from at least one monomer selected from the group consisting of acrylic, vinyl, chlorinated vinyl, styrene, butadiene, ethylene, butene, and copolymers or blends thereof. A preferred coating composition is polymer or copolymer of a vinyl compound, or halogenated polyolefin, e.g., polyvinyl chloride, polyvinylidine chloride, polyethylene chloride, polyvinyl acetate, polyvinyl acetyl, chlorinated polyethylenes, and the like, and copolymers and mixtures thereof. A specific example of a resin coating composition is a vinyl chloride, resin-based plastisol, wherein the plasticizer component of the plastisol is a phthalate-based compound, such as an alkyl phthalate substituted one or two times with a linear or branched C5–C12 alkyl group, which is included in an amount by weight equal to between about 15 to 60 percent of the weight of the vinyl chloride resin component. Particularly preferred vinyl chlorides include Vinycel 124 (Policyd SA DE CV, Mexico), Geon Registered TM 13 oz (Geon Company, Cleveland, Ohio), Pliovic M-70 (The Goodyear Tire and Rubber Company, Akron, Ohio), and Oxy 67SF (Occidental Chemical Corp., Dallas, Tex.). Particular alkyl phthalate plasticizers include Santicizer Registered TM 160 (Monsanto Company, Saint Louis, Mo.), Palatinol Registered TM 711P (BASF Corporation, Parsippany, N.J.), and Jayflex DHP (Exxon Chemical America, Houston, Tex.).

The secondary backing can be a cushion-backed backing or a hard back backing. In more detail, the secondary backing can be a solid thermoplastic backing or a foamed thermoplastic backing. Again, preferably the thermoplastic foamed backing is preferably a foamed vinyl backing and more preferably a polyvinyl chloride foamed backing, such as a closed-cell vinyl foamed backing. Generally, the secondary backings will contain at least one plasticizer, in conventional amounts, like about 50 phr to about 80 phr and can include other ingredients, like wetting agents conventionally used in secondary backings.

Chemically expanded thermoplastic foamed backings can be used as the secondary backing and can be prepared by casting a thermoplastic resin plastisol containing at least one blowing agent onto the back of the primary backing and heating to expand and fuse the plastisol. Alternatively, a pre-blown foamed secondary backing can be laminated, such as by heat, to the primary backing. The solid thermoplastic secondary backing can be similarly prepared by casting or by lamination.

Conventional blowing agents can be used and include, but are not limited to azodicarbonamide, p,p-oxybis (benzenesulfonylhydrazide), p-toluenesulfonylhydrazide, and the like, such as the ones described in U.S. Pat. No. 3,661,691 incorporated its entirety by reference herein.

In the present invention, the secondary backing preferably contains one or more types of polymeric microspheres, which are preferably hollow particles and preferably contain a thermoplastic shell encapsulating a gas. A blowing agent, like isobutane or isopentane is inside the shell, wherein the shell is a copolymer of monomers, like vinylidene chlorde, acrylonitrile and methylmethacrylate, and the like. Preferably, polymicrospheres are DUALITE® low density microspheres, such as DUALITE® M6032AE or M7000, or Expancel® type polymeric microspheres. The Expancel microspheres are available from Akzo Nobel, Duluth, Ga. The DUALITE® polymeric microspheres are available from Pierce & Stevens Corporation, Buffalo, N.Y. Specific types of Expancel microspheres are set forth in the examples, and include 551DE, 461DE, 551-20, 461-20, 051, 053, 054, 091DE, 091-80, and 092-120. The microspheres can be added in dry form or as a slurry for purposes of the present invention. Generally the particle diameter for the Expancel microspheres will be from about 15 microns to about 50 microns and having a true density of from about 0.030 to about 0.70 g/cc. Preferably, the polymeric microspheres are heat resistant to a temperature of at least about 300° F., for about five to about ten minutes, or more preferably are heat resistant to a temperature of at least 350° F. for about five to about ten minutes. In the present invention, preferably the polymeric microspheres can withstand pressures of at least 500 psi, more preferably withstand pressures of up to 1,000 psi, and most preferably, withstand pressures of up to 2,000 psi without microsphere breakage. Generally, for purposes of the present invention, the polymeric microspheres can be present in any amount that is compatible with the thermoplastic material and to accomplish the purposes of the secondary backing layer. For instance, the polymeric microspheres can be present in the secondary backing in an amount of from about 5 parts to about 100 parts or more per 100 parts by weight resin, and more preferably be present in a range of from about 5 parts per 100 parts by weight resin to about 50 parts per 100 parts by weight resin, and more preferably from about 10 parts per 100 parts by weight resin to about 30 parts per 100 parts by weight resin. Generally, with a hardback secondary backing, more polymeric microspheres are present than with a foamed secondary backing. Preferably, the hardback secondary backing can have from about 10% to about 60% by weight more polymeric microspheres than a foamed secondary backing of the present invention. In addition, or as an alternative, polymeric microspheres can be present in any one or more of the other layers of the surface covering, except the primary backing. Amounts in these layers will depend on the desired results to be achieved.

Preferably, a blowing agent is also present with the polymeric microspheres. Generally, any amount of blowing agent can be used. Preferably, amounts from about 0.5 phr to about 5.0 phr, and more preferably from about 2.0 phr to about 3.0 phr can be used. Examples of blowing agents include, but are not limited to, the blowing agents described above. Other examples include Celogen forming agents from Uniroyal Chemical; Ficel blowing agents from Bayer AG; Azo foam products from Otsuka Chemical Co, Ltd.; and Unicell products from Dong Jin Chemical Industries Co. L.H. Along with the blowing agent(s), conventional activator(s) are used.

If a blowing agent is used in the present application, while any blow ratio can be used, preferably the blow ratio is from about 1.0 to about 2.5, and more preferably is from about 1.5 to about 2.0, and is most preferably about 1.7 or about 1.8. With such a preferred blow ratio in combination with the polymeric microspheres, the surface coverings of the present invention can be made in a 1-step process as explained in more detail below. In particular, when a lower blow ratio is used compared to conventional blow ratios which are on the order of magnitude of above 2.5 and generally more on the order of 3 to 4, it is difficult to achieve a consistent thickness across the entire product due to such a high blow ratio which makes maintaining uniform thickness of the layer containing the blowing agent practically impossible due to such a large expansion of the layer. Such conventional blow ratios are generally desired in conventional products, if not required due to the desired density of the layer as well as the final product. Unlike the conventional surface coverings, the present invention avoids the need for such a high blow ratio by using polymeric microspheres in combination with one or more blowing agents which achieves the desired density but without the need for such a high blow ratio. In addition, with conventional blow ratios on the order of magnitude of 3 or 4, high temperatures are required to achieve such expansions of the layers and thus a 1-step process of forming a surface covering is not used for conventional products. Instead, the foam containing layer in conventional products must be formed separately and then laminated on to the primary backing. The present invention, in at least one embodiment, overcomes this problem by a 1-step process which permits the wet-on-wet formation of the foam containing layer or the layer on the primary backing or other layer because lower temperatures are used in forming the foam containing layer (e.g., such as the secondary backing). Lower temperatures to cause the expansion of the foam containing layer can be used because of the lower blow ratio desired in combination with the polymeric microspheres. High temperatures can not be used when forming layers on the primary backing because damage would occur to the primary backing, however with the use of lower temperatures such as below 360° F., the foam containing layer can be formed directly on the primary backing without damage to the primary backing.

In making the secondary backing containing the polymeric microspheres, the ingredients comprising the secondary backing are preferably in liquid form such as the plasticizer, stabilizer, resins, and any other additional or optional ingredients, such as a foaming or blowing agent. While the ingredients comprising the secondary backing are in liquid form, the desired amount of polymeric microspheres are preferably added and dispersed amongst the liquid phase of the secondary backing. Then, the secondary backing is applied as a liquid layer onto the primary backing or any optional intermediate layer in a conventional manner known to those skilled in the art, such as with the use of a doctor blade. The thickness of the secondary backing layer can be any thickness desired by the user and conventional thicknesses can be used. Preferably, the secondary backing has a thickness of from about 10 mils to about 50 mils and more preferably from about 30 mils to about 40 mils after curing. When a foamed secondary backing is used, the preferred thickness is from about 50 mils to about 150 mils in thickness and more preferably from about 100 mils to about 140 mils in thickness, after curing.

The primary backing in the present application can be any conventional primary backing and the textile fibers extending upwardly from the primary backing and forming a surface can be any conventional textile fibers. In more detail, the primary backing or base fabric as it is also known, can be woven, for example, woven jute, woven polypropylene film, burlap, and the like, or may be non-woven fabric, e.g., needle punched, non-woven polypropylene web, and the like. Preferably, the primary backing, is a synthetic tufting substrate, and more preferably is a non-woven polyester. In the preferred embodiment of the present invention, beneath the primary backing is an adhesive or polymeric precoat layer. This adhesive or polymeric precoat layer can be a precoat of latex or a hot melt adhesive (such as SBR latex), PVC, EVA acrylic, and other hot melt adhesives which are known to those skilled in the art. Preferably, the adhesive or polymeric precoat layer is a polyvinyl chloride. This layer is primarily used to maintain permanently the textile fibers in the primary backing with the use of a heat-sensitive coating composition applied to the back surface of the primary backing which, when heat is applied to the composition, the fibers are fused to the primary backing. This adhesive or polymeric precoat layer can optionally have polymeric microspheres dispersed therein in addition or as an alternative to the presence in the secondary backing.

Figure 2:
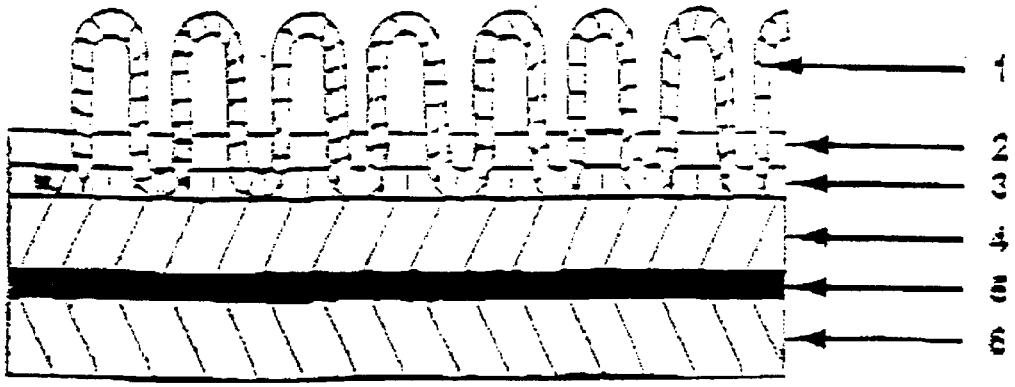

Beneath the optional adhesive or polymeric precoat is an optional intermediate backing layer. This optional layer can be made from the same material as the secondary backing, but its location is different within the textile substrate, as shown in FIGS. 1 and 2. Preferably, the intermediate backing is a hard back and is not a foamed layer. While the intermediate backing can contain polymeric microspheres, in the preferred embodiment, the intermediate coating is preferably a thermoplastic material, like the secondary backing, but with or without polymeric microspheres. Preferably, the intermediate backing is also a polymer or copolymer of a vinyl compound, and preferably a polyvinyl chloride.

The thickness of the intermediate backing can be the same as that of the non-foamed secondary backing. The intermediate coating can be applied in a similar matter as other liquid coatings such as hot melt coating by extrusion, a heated doctor blade, or bypassing the bottom surface of the layer in contact with the top surface of a rotating roller partially submerged in a tank of the molten thermoplastic material. Preferably, the liquid thermoplastic material is applied with the use of a doctor blade in order to control the thickness of the liquid material on the roller.

Beneath the optional intermediate backing can be an optional reinforcement material layer or stabilizer layer. Generally, any reinforcement-type material can be used in this optional layer. This layer is preferably a non-woven material, such as a non-woven fiberglass cloth. Such a reinforcement material layer is generally placed on the bottom surface of the intermediate backing while the intermediate layer is still in a liquid or gel state.

In the preferred embodiment, the secondary backing layer can then be affixed to the intermediate backing layer with or without the reinforcement layer being present in between the two layers.

Preferably, the surface covering (e.g., the carpet) has a density of from about 20 to about 45 lbs. per cubic foot density, and more preferably from about 25 to about 40 lb. per cubic foot density and even more preferably from about 20 to about 30 lb per cubic foot density.

A preferred formula for the secondary backing is:

| Ingredients | PHR |
|---|---|
| Jayflex 77 | 55.4 |
| S-160 | 24.9 |
| (Geon 180X7 | 80 |
| Borden 260SS | 20 |
| Expancel DE-91 | 3 |
| Az-120 | 2.5 (blowing agent from Uniroyal) |
| PD700 | 2.6 (kicker-zinc octane from Ferro) |

The Table below provides preferred coating amounts, thicknesses, and cure temperature and times for the preferred embodiment.

TABLE 1

| Layers | Weight oz/sy | Thickness in Mils | Cure Temp. | Residence Time Approx. |
|---|---|---|---|---|
| Pre-Coat | 40 | 39 | 320° F. | 1 min. 15 Sec. |
| Hard Secondary Backing | 40 | 35 | 320° F. | 5 mins. |
| Foamed Secondary Backing | 40 | 130 | 320° F. | 5 mins. |

With the textile substrates using the secondary backing of the present invention, the need for a high blow ratio can be avoided when a blowing agent is used and a 1-step process can be achieved by pouring a liquid thermoplastic material with the polymeric microspheres onto the back of the primary backing or other layers that may be present. This has a distinct advantage over the conventional 2-step process which must first form a foam layer (in a separate process) having a controlled thickness which is then subsequently laminated to a carpet backing in a separate process. Even when a foaming or blowing agent is used in the secondary backing of the present invention, a separate process of forming the foam layer is not necessary, in part because the microspheres are present, thus resulting in a lower blow ratio to achieve the desired foam density. In other words, with the present invention, the foaming can occur on the same manufacturing line as the rest of the carpet or other surface covering. Also, with the optional layers present, distinct advantages can be achieved compared to conventional carpets, such as a moisture barrier created by the adhesive or polymeric precoat and also superior dimensional stability with the use of a reinforcement material such as a fiberglass material. Also, excellent physical properties can be achieved, such as moisture absorbency, density, compression set, and compression force deflection as well as a lower moisture absorption foam.

With respect to resilient floor coverings and vinyl-type floor coverings, the secondary backing of the present invention can be incorporated into such floor covering products. For instance, a foam layer or pre-gel layer containing a polymeric material and a blowing or foaming agent along with the polymeric microspheres can be used. Generally, such a layer is located between a conventional substrate layer and a wear surface. The wear surface and/or other top coat layers can be considered primary backings for purposes of the present invention. The wear surface can comprise a base coat and a top coat. The flooring products set forth in the following U.S. patents can be used wherein the layer containing the polymeric material with the blowing or foaming agent further includes the polymeric microspheres disclosed herein. As an alternative, the layer traditionally viewed as the foam layer can be prepared using polymeric material and polymeric microspheres without the presence of a blowing or foaming agent just as described earlier as one of the possible embodiments above. Accordingly, U.S. Pat. Nos. 4,675,212, 4,409,280, 4,128,688, 4,756,951, 4,863,782, 5,338,504, and 5,405,674 are all incorporated in their entirety herein by reference.

In another embodiment of the present invention, the use of polymeric microspheres are not necessary and a surface covering can be prepared wherein the secondary backing contains at least one thermoplastic material and at least one activated blowing agent wherein the secondary layer is preferably expanded from its original thickness by about 1 to about 2.5 times (blow ratio), and more preferably about 1.5 to about 1.8 times. The secondary backing is coated onto the primary backing such that there is no delamination, for instance, as tested under ASTM-D-3936. This secondary backing can be used for a variety of surface coverings and can be fixed to primary backings for textile substrates or vinyl-type floorings. The method of preparing such a surface covering involves applying a secondary backing formulation comprising at least one liquid thermoplastic material, at least one blowing agent, and at least one activator onto the back of a substrate comprising a primary backing layer; gelling the formulation and activating the blowing agent; and curing the formulation to form the surface covering comprising the primary backing layer and the secondary backing layer. Other conventional layers can be included depending upon the intended end use, including some of the optional layers, if not all the optional layers, described above.

The present invention will be further clarified by the following examples, which are intended to be purely exemplary of the present invention.

EXAMPLES

Example 1

A secondary backing was made in the following manner:

Raw materials used were PVC Dispersion Resin, PVC Blending Resin, Jayflex 77 and Santicizer 160 plasticizer, Vanstay 5956 stabilizer, Printex G carbon black powder and Dualite M6032 or M7000 Microspheres. The batching equipment was a Nauta Planetary Mixer, model MBX-1225 with a 900 gallon working capacity.

First, 80% by weight of the plasticizer total was added to the mixer. The Dualite® polymeric microspheres were then charged manually into the Nauta mixer. The Vanstay 5956 stabilizer and Printex G carbon black were then added, and the mixer turned on. Both PVC resins were added and allowed to mix until smooth. The remaining plasticizer was added and allowed to mix.

A 10 fluid ounce sample was taken and tested for viscosity using a Brookfield RVF viscometer at 20 rpm with a #7 spindle. The sample was also checked for gelation temperature and density. The compound was then pumped to a tile line second coater for coating onto the carpet back.

Carpet Production

The tile line is a two level process, with a top section and a bottom section.

The carpet to be coated was placed in the sew-on cradle at the end of the tile line. The carpet was sewn onto the end of the previous roll, using a butt-type sewing seamer. The roll being sewn on was oriented face down on the sew-on table. After sewing on, the carpet was pulled into a J-box, where it stayed until pulled into the line.

As the carpet in the line ran out of the J-box, it went into the top section and through a guider to maintain alignment, and then onto a belt which carried it into a steamer. This prepared the carpet to accept any topical treatments that may be required. After exiting the steamer, the carpet went through the foam station. Any topical finishes, such as biocides or fluorochemicals were applied here. The carpet then went onto another belt and was carried into a drying oven, where it is dried at about 225° F. The carpet then left this oven and was pulled across the remaining top section.

At the end of the top section, the carpet took a 90° turn down, ran for about another 10 feet, and took a second 90° turn, placing it in a face down orientation as it entered the bottom part of the tile line. The carpet then went through a tension control station, through a guider and into the precoat coater station. Here, about 40 to 45 ounces per square yard of vinyl precoat was applied, using a knife over roll coater. The carpet left the station and traveled around a gel roll, which was heated to about 300° F. The carpet had a 90% wrap around the gel roll surface. The carpet then left the gel roll, and passed through a Tenter infrared oven, where the carpet was heated to about 320° F. The carpet then exited the oven, passing underneath the fiberglass roll, and entered the first coated station. The carpet passed through a knife over roll coater, where about 30 to 35 mils of hardback liquid vinyl was applied. Immediately after that a layer of non-woven fiberglass was placed onto the liquid vinyl hardback, and the assembly was passed through a laminating nip roll, which squeezed the carpet to the fiberglass. This nip was set at the same setting as the first coater setting. The carpet then passed through the fiberglass station oven, where the vinyl gelled at about 300° F.

The present invention's secondary backing as described in Table 2 was applied at the second coater station, after the carpet exited the fiberglass station oven. This was done with a knife over roll coater, which was set from about 80 mils to about 125 mils above the fiberglass laminating nip roll setting. The carpet then passed through the second coater infrared oven which was used to gel the vinyl secondary backing. The carpet then moved into the four zone oven using a belt transport to carry the carpet. The oven has steam-heated plates underneath the carpet to maintain carpet temperature, which are operated at between about 65 psi to about 100 psi. The four zone oven passed heated air across the carpet, raising the vinyl temperature to about 320 to about 350° F. The dwell time was about 5 to about 7 minutes. The carpet exited the four zone oven, and passed through the embosser infrared oven, which raised the surface temperature of the vinyl layer to about 325° F. This prepared the carpet for mechanical embossing of arrows. The embosser roll was set about 100 to about 125 mils below the knife at the second coater station.

When the carpet left the embosser infrared oven, the heating process was complete. The carpet then left the belt, and passed over chilled rolls, which operated at a circulating water temperature of about 35 to about 40° F. The carpet was oriented face out. This cooled the carpet down for preparation for cutting. The carpet passed through a turn bar, which changed the orientation to face up. The carpet entered an accumulator, which allowed the cutting press to stop without stopping the tile line. The carpet left the accumulator, and entered the cutting press. There the carpet was cut face up into 18 inch by 18 inch squares, 8 tiles per cut. The tiles were carried down an inspection line, where they are checked for defects, and any fizzy edges trimmed on rotating bevel cutters.

An alternate means of finishing was employed with 6 foot roll goods. In this case, the tile press was bypassed, and the carpet rolled up on a surface winder station at the exit end of the accumulator.

Process settings were as follows:

1. Second knife applicator set at 80 to 125 mils above the Fiberglass Laminating Nip.
2. The Embosser set 100 to 125 mils below the Second Station Coater.
3. Line speed was 13 to 15 fpm.
4. Oven residence time was 5 to 7 minutes.
5. Process Tension-minimum required throughout the process.

Finished Product

1. Total weight of the backing was 120 oz/sq yd.
2. Foam thickness was about 0.125 inches.
3. Total thickness was 0.400 inches.
4. Foam density 25 to 30 lb. per cubic foot.
5. Compression Resistance@25% :25.1 PSI.
6. Compression Set: 15.0%
7. Moisture Absorbency: 2.2[{]ps The particular amounts of the hardback and foamed secondary backing ingredients per parts per 100 resin are set forth in Table 2.

TABLE 2

| Chemical | Standard Hardback | Hardback Secondary Backing | Resilient Foam Secondary Backing |
|---|---|---|---|
| Plasticizer (Jayflex 77) | 61 | 115 | 55 |
| Plasticizer (DINP) | 30 | 0 | 0 |
| Plasticizer (S-160) | 0 | 0 | 25 |
| Stabilizer (Vanstay 5956) | 0.5 | 1 | 1 |
| Carbon Black (Printex G) | 0.8 | 1 | 1 |
| Blowing Agent (Celogen OT) | 0 | 0 | 2.5 |
| Activator for Blowing Agent (Kadoz 920) | 0 | 0 | 1.3 |
| Resin (Geon 138) | 0 | 100 | 0 |
| Resin (EH 76) | 85 | 0 | 0 |
| Resin (Oxy 625) | 0 | 0 | 80 |
| Blending Resin (VC 260SS) | 15 | 0 | 20 |
| Filler $CaCO_3$ (MW 190) | 215 | 0 | 0 |
| Dualite ® microspheres | 0 | 25 | 13 |
| Alsil 01TR | 8 | 0 | 0 |
| Dust Collector Reclaim | 2 | 0 | 0 |
| | 417.3 | 242 | 198.8 |

Based on parts per 100 resin.

Example 2

A secondary backing was made in the following manner:

Raw materials used were PVC Dispersion Resin, PVC Blending Resin, Jayflex 77, Jayflex DINP and Santcizer 160 plasticizers, AZ 120 blowing agent, Ferro TC5583 activator, Printex G carbon black powder and Expancel 091-DE80 microspheres. Table 3 sets forth the amounts.

TABLE 3

| | Phr | Chemical | Amount (lbs.) |
|---|---|---|---|
| 1 | 55.4 | Jayflex 77 (plasticizer) | 1,110 |
| 2 | 24.9 | Santicizer 160 (plasticizer) | 500 |
| 3 | 2.5 | AZ 120 (blowing agent) | 50 |
| 4 | 2.6 | TC 5583 (activator) | 52 |
| 5 | 1.00 | Printex G (carbon black) | 20 |
| 6 | 80.0 | VC 433 (resin) | 1,600 |
| 7 | 20.0 | VC 260SS (blending resin) | 400 |
| 8 | 3.0 | Expancel 091 DE80 (microspheres) | 60.0 |

The batching equipment used was a Hockmeyer disperser.

First, the Jayflex 77 and DINP plasticizers were added to the mixer and then the S60 plasticizer was added into the mixer. Afterwards, the blowing agent (AZ120) and activator (TC 5583) were added into the mixture at low speed and then were mixed at high speed for 5 minutes. Then, with the mixer again set at low speed the carbon black powder was added and then the dispersion resin was then added and the mixture mixed for 8 minutes. Afterwards, the blending resin was added while the mixer was set at low speed and mixed for 3 minutes and then the polymeric microspheres were added while the mixture was at low speed. Complete mixing then occurred ensuring that the temperature did not exceed 95° F. The sample was tested for viscosity as in Example 1.

Then, the formulation was used in the formation of a secondary backing using the same process as set forth in Example 1. The process settings that were used in this example are set forth below:

1. Line speed was 14 to 16 fpm;
2. Oven residence time was 5 to 7 minutes;
3. Process Tension—minimum required throughout the process;

4. Initial Foam Density-Liquid—5.1–6.0 Lbs/gal;
5. 1st Coater Wet Film Thickness—30 mils.;
6. 2nd Coater Wet Film Thickness—70–80 mils.;
7. Infrared Heater Settings, deg. F.;

| | |
|---|---|
| #1 IR | std |
| #2 IR | 175 |
| #3 IR | 160 |
| #4 IR | off |

8. 4 Zone Air Temp Settings, deg. F.;

| | |
|---|---|
| Zone 1 | 325 |
| Zone 2 | 335 |
| Zone 3 | 345 |
| Zone 4 | 345 |

Finished Product:

1. Total weight was slightly less than a standard hardback tile.
2. Foam thickness was 0.125 inches.
3. Foam density was 22–26 Lb. per cubic foot.
4. Compression Resistance @ 25%: 25.1 PSI.
5. Compression Set: 15.0%
6. Moisture Absorbency: <10%
7. Delamination—the back will not delaminate.
8. Foam Weight—34 oz/sq. yd.

Example 3

Example 2 was repeated expect the initial layer of vinyl hard back was replace with the same foam formula that was applied at the second coater station. The particular process settings used in this process were as follows:

1. Line speed was 14 to 16 fpm;
2. Oven residence time was 5 to 7 minutes;
3. Process Tension—minimum required throughout the process;
4. Initial Foam Density-Liquid—5.3–5.6 Lbs/gal;
5. 1st Coater Wet Film Thickness—30 mils.;
6. 2nd Coater Wet Film Thickness—40–50 mils.;
7. Infrared Heater Settings, deg. F.;

| | |
|---|---|
| #1 IR | std |
| #2 IR | 175 |
| #3 IR | 160 |
| #4 IR | off |

8. 4 Zone Air Temp Settings, deg. F.;

| | |
|---|---|
| Zone 1-350° | (340–355) |
| Zone 2-350° | (340–355) |
| Zone 3-350° | (340–355) |
| Zone 4-350° | (340–355) |

Finished Product:

1. Total weight was slightly less than a standard hardback tile, 112 ozs/sq yd.
2. Foam thickness was 0.125 inches.
3. Foam density was 22–26 Lb. Per cubic foot.
4. Compression Resistance @ 25% : 25.1 PSI.
5. Compression Set: 15.0%
6. Moisture Absorbency: <10%
7. Delamination—the back will not delaminate.
8. Foam Weight—34 oz/sq. yd.

As can be seen from the results, the secondary backing had an enhanced softer more cushioned feel compared to the secondary backing made in Example 1 and 2.

Example 4

In this example, the formulation as set forth in Example 2 was prepared except Expancel 009-DU80 unexpanded polymeric microspheres were used and no blowing agent was present in the formulation. The formulation is set forth in Table 4.

TABLE 4

| Chemical | Phr |
|---|---|
| Jayflex 77 (plasticizer) | 55 |
| DINP - Exxon (plasticizer) | 25 |
| V5956 (stabilizer) | 0.5 |
| Printex G (carbon black) | 1 |
| VC 433 (resin) | 80 |
| VC 260SS (blending resin) | 20 |
| Expancel 009DU (microspheres) | 3 |

The secondary backing was prepared in the same manner as described in Example 1. The particular process settings that were used are set forth below:

1. Line speed was 14 to 16 fpm;
2. Oven residence time was 5 to 7 minutes;
3. Process Tension—minimum required throughout the process;
4. Initial Foam Density-Liquid—10–11 Lbs/gal;
5. 1st Coater Wet Film Thickness—30 mils.;
6. 2nd Coater Wet Film Thickness—40–50 mils.;
7. Infrared Heater Settings, deg. F.;

| | |
|---|---|
| #1 IR | std |
| #2 IR | 175 |
| #3 IR | 160 |
| #4 IR | off |

8. 4 Zone Air Temp Settings, deg. F.;

| | |
|---|---|
| Zone 1 | 325 |
| Zone 2 | 335 |
| Zone 3 | 345 |
| Zone 4 | 345 |

Finished Product:

1. Total weight was from 76 oz/sq yd to 80 ozs/sq yd.
2. Foam thickness was 0.125 inches.
3. Foam density was 22–26 Lb. per cubic foot.
4. Compression Resistance @ 25%: 25.1 PSI.
5. Compression Set: 15.0%
6. Moisture Absorbency: <5%
7. Delamination—the back will not delaminate.
8. Foam Weight—34 oz/sq. yd.

The product obtained in this example was a totally closed cell foam since the particular polymeric microspheres used in this example expanded upon the application of heat. Since no expansion gases evolved, there was no channeling of the foam structure which minimized moisture absorption and improved physical properties, such as compression set.

For purposes of the present invention, preferably the secondary backing of the present invention has the following specifications.

| | |
|---|---|
| Primary Substrate: | 100% Synthetic |
| Precoat Layer: | Closed Cell Vinyl, Non-Acquaous Polymer |
| Adhesive Layer: | Closed Cell Vinyl, Non-Acquaous Polymer |
| Stabilizing Membrane: | Non-Woven Fiberglass |
| Cushion Layer: | Syntactic and Chemically Blown Vinyl Cushion |
| Cushion Cell Structure: | Closed Cell |
| Cushion Volume Density: | 24 lbs/ft$^3$ avg. |
| Cushion Layer Weight: | 32 oz./s.y. |
| Total Backing Weight: | 120 oz./s.y. (Style Dependent) |
| Roll Width: | Six Ft. |
| or | |
| Tile Size: | 18" × 18" Standard |
| Methenamine Pill Test (FFI-70): | Passes |
| Radiant Panel (ASTME-648) | Class I. Greater than |
| Watts/cm$^2$: | .45 |
| NBS Smoke (ASTME-662); | 450 or Less, Flaming Mode |
| Combustion Toxicity | Registered |
| (Univ. Of Pittsburgh): | N.Y. State |
| Indoor Air Quality | <500 |
| (EPA Protocol) TVOCS: | mg/m$^2$ · hr |
| Dimensional Stability | ±.02%– |
| (Aachen Test): | ±.05% avg |
| Foam Delamination lbs. | No |
| ASTM D-3936: | Delamination |
| Compression Force Defection | |
| 25%, psi (ASTM D-1667): | min. 7.0 |
| Compression set, (ASTM D-1667): | max. 8% |

Other embodiments of the present invention will be apparent to those skilled in the art from consideration of these specification and practice of the present invention disclosed herein. It is intended that the specification and examples be considered as exemplary only, with a true scope and spirit of the invention being indicated by the following claims.

What is claimed is:

1. A textile substrate comprising a primary backing with textile fibers extending upwardly from the backing and forming a surface:

and a secondary backing affixed to the bottom surface of the primary backing wherein said secondary backing comprises at least one thermoplastic material having polymeric microspheres dispersed therein, wherein said thermoplastic material comprises a polymer or copolymer of a vinyl compound, and at least one plasticizer.

2. The textile substrate of claim 1, wherein said textile substrate is a carpet.

3. The textile substrate of claim 1, wherein said textile substrate is a broadloom carpet, modular tile, or wide roll carpet.

4. The textile substrate of claim 1, further comprising at least one adhesive or polymeric pre-coat layer located beneath the primary backing.

5. The textile substrate of claim 4, further comprising at least one intermediate backing layer located beneath the adhesive or polymeric pre-coat layer.

6. The textile substrate of claim 5, further comprising at least one reinforcement material layer or stabilizer layer located beneath said intermediate backing layer.

7. The textile substrate of claim 1, wherein said textile substrate has a density of from about 20 to about 45 lb/ft$^3$ density.

8. The textile substrate of claim 1, wherein said textile substrate has a density of from about 20 to about 30 lb/ft$^3$ density.

9. The textile substrate of claim 1, wherein the secondary backing and the primary backing are affixed such that there is no delamination under ASTM D-3936.

10. The textile substrate of claim 1, wherein said secondary backing further comprises at least one activated blowing agent.

11. The textile substrate of claim 10, wherein said secondary backing and primary backing are affixed such that there is no delamination under ASTM D-3936.

12. The textile substrate of claim 10, wherein said blowing agent is present in an amount of from about 0.5 to about 5.0 per 100 parts by weight thermoplastic material.

13. A surface covering comprising a primary backing and overlying and adhered to said primary backing is a secondary backing comprising at least one thermoplastic material having polymeric microspheres dispersed therein and at least one activated blowing agent, wherein said secondary backing is casted on said primary backing, and wherein said thermoplastic material comprises a polymer or copolymer of a vinyl compound and at least one plasticizer.

14. The surface covering of claim 13, wherein said secondary backing is expanded by about 1.0 to about 2.5 times.

15. The surface covering of claim 13, wherein said secondary backing and primary backing are affixed such that there is no delamination under ASTM D-3936.

16. The surface covering of claim 13, wherein said primary backing comprises a textile substrate.

17. A surface covering comprising a primary backing;

at least one adhesive or polymeric precoat layer located and affixed to the primary backing;

optionally at least one intermediate backing layer located beneath and affixed to the adhesive or polymeric pre-coat layer;

optionally at least one reinforcement material layer or stabilizer layer located and affixed beneath the adhesive or polymeric pre-coat layer or intermediate backing layer;

and a secondary backing comprising at least one thermoplastic material located and affixed to either the adhesive or polymeric pre-coat layer or one of the optional layers; and wherein polymeric microspheres are dispersed in at least one of the layers except the primary backing, wherein said thermoplastic material comprises a polymer or copolymer of a vinyl compound, and at least one plasticizer.

18. The textile substrate of claim 1, wherein said textile substrate is a modular carpet tile.

19. The textile substrate of claim 1, wherein said textile substrate is a six foot wide carpet.

20. The textile substrate of claim 10, wherein said secondary backing is a closed-cell foam.

21. The textile substrate of claim 13, wherein said secondary backing is a closed-cell foam.

22. The textile substrate of claim 17, wherein said secondary backing is a closed-cell foam.

* * * * *